United States Patent [19]

French

[11] 3,956,966

[45] May 18, 1976

[54] FAIL SAFE POWDER TEMPERATURE SENSOR FOR TANK FIRE CONTROL SYSTEM

[75] Inventor: William E. French, Hawthorne, Calif.

[73] Assignee: The United States of America as represented by the Secretary of the Army, Washington, D.C.

[22] Filed: July 26, 1974

[21] Appl. No.: 492,082

[52] U.S. Cl. ..... 89/41 ME; 73/362 SC; 307/304

[51] Int. Cl.[2] ..... F41G

[58] Field of Search ..... 73/362 SC; 89/41 ME; 235/61.5 R, 61.5 E; 307/304, 310, 235 J

[56] References Cited

UNITED STATES PATENTS 3,453,887 7/1969 Wooten ..... 307/304

3,720,131 3/1973 Frohock et al. ..... 89/41 ME

*Primary Examiner*—Stephen C. Bentley

*Attorney, Agent, or Firm*—Nathan Edelberg; Robert P. Gibson; Arthur M. Suga

[57] ABSTRACT

A tank temperature sensing network for propellant powder contained within the tank, said network employing resistors and a field effect transistor for putting out a voltage to a summing amplifier proportional to target range and powder temperature, the amplified voltage being fed either into a computer through a detector set at a predetermined reference voltage for correcting ballistic lead angle when said amplified voltage is less than the detector reference voltage or to trigger a fail light when the amplified voltage is greater than said predetermined detector reference voltage.

3 Claims, 2 Drawing Figures

FAIL SAFE POWDER TEMPERATURE SENSOR FOR TANK FIRE CONTROL SYSTEM

The invention described herein may be manufactured, used and licensed by or for the Government for governmental purposes without the payment to me of any royalty thereon.

This invention relates to fire control systems and more particularly concerns such systems which provide fail-safe ammunition powder or propellant temperature sensing capabilities.

Combat effectiveness of the U.S. M60A1 tank is currently being optimized. Among the many improvements that have been developed for this tank is a powder temperature sensor. Since the ballistics and velocity of a fired projectile are at least partially dependent on the temperature of propellant powder associated therewith, any optimization of the tank fire control system must compensate for, or take into account, powder temperature variations. Thus, if the temperature of the propellant powder varies within certain predetermined limits from a given powder temperature, signals from my powder temperature sensing network can be fed into computational circuits for correcting the ballistic lead angle to compensate for this powder temperature variance. Similarly, if the powder temperature is considerably outside the specified temperature limits of the system, my powder temperature sensing network will alert the tank gunner through the triggering of a fail light and no correction signals will be fed into the computer.

My device is simple to use and construct, has good sensitivity-accuracy features, requires no complex thermistor bridge circuits as is used in the prior art and yet complies with a tank system such as the U.S. M60A1 tank fire control system powder temperature sensor requirements, to be discussed hereinafter.

Accordingly, it is an object of the invention to provide a fail-safe device for estimating powder temperature of ammunition physically located within a tank.

Another object of the invention is to provide such a device which is completely devoid of any thermistor bridge circuitry.

Still another object of the invention is to provide such a device which utilizes a simple field effect transistor as a switching means when the powder temperature falls within or without a predetermined powder temperature range.

Yet another object of the invention is to provide a device that generates a specified lead angle signal based upon powder temperature.

Figure 1:
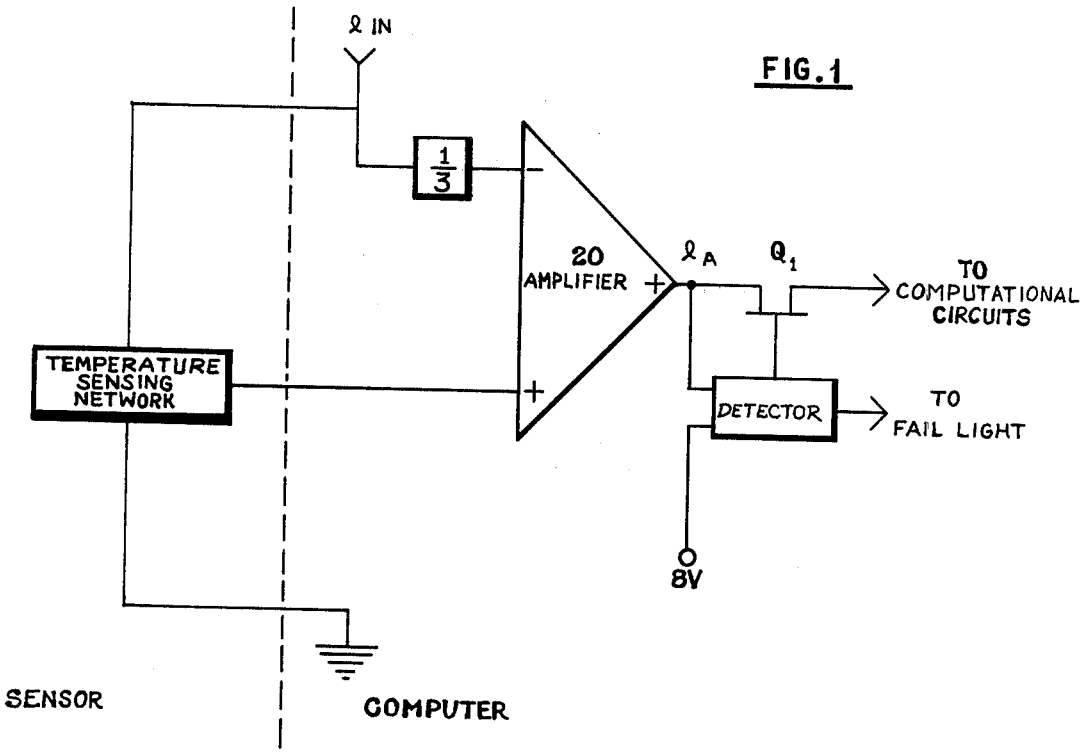
Figure 2:
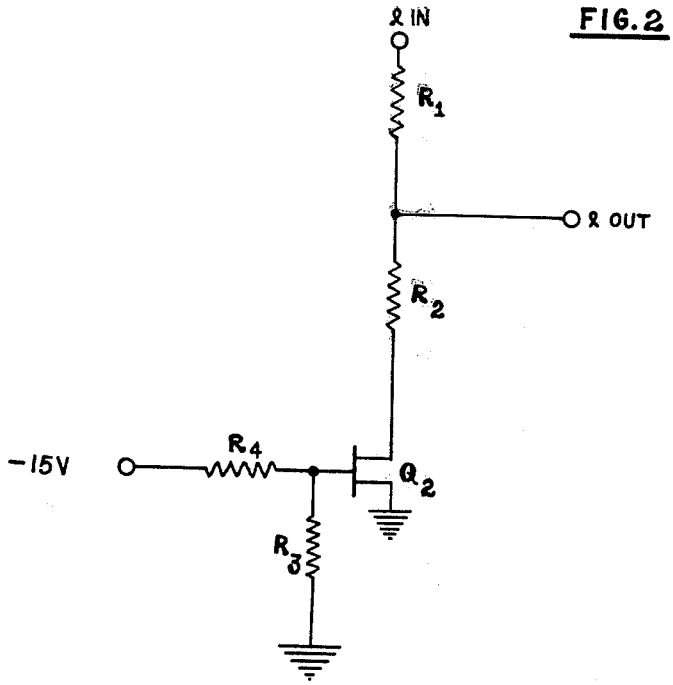

The exact nature of this invention as well as other objects and advantages thereof will be apparent from consideration of the following description and drawings wherein:

FIG. 1 is a block diagram of my powder temperature sensing device connected to the computer used in M60A1 tanks; and FIG. 2 is a circuit diagram of the powder temperature sensing device of FIG. 1.

In accordance with the above objects and drawings, I have provided a device which utilizes the variation of dynamic resistance with temperature of a Field Effect Transistor, the device meeting requirements for the M60A1 Tank Fire Control System powder temperature sensor, the requirements being summarized below:

a. Input Signal ($e_{in}$): Variable from 1.5 to 6.0 volts rms, 400 Hz, depending on target range.

b. Output Signal ($e_{out}$): Function of the input voltage and temperature in accordance with the following equation:

$$e_{out} = e_{in}/3 + 0.667 \times 10^{-3} e_{in}(T-20°C) \quad (1)$$

where $T$ is ambient temperature in °C.

c. Accuracy: The permissible error, in volts, as a function of $e_{in}$ and $T$, is given by equation 2:

$$\text{Error} = \Delta e_{out} = 1.3 \times 10^{-3} e_{in} + 1.1 \times 10^{-4} e_{in}(T-20°) \quad (2)$$

d. Output Impedance: Equal to or greater than 2000 ohms.

Referring now to the drawings, and more particularly to FIG. 1 thereof, since voltage $e_{in}$ is proportional to target range, voltage $e_{out}$ will be a function of target range and temperature, as indicated by eq. 1. The M60A1 tank employs a minimum and maximum target range which corresponds respectively with the 1.5 to 6.0 volts predetermined range of the input signal. My temperature sensing network (hereinafter referred to as TSN) to be described more fully hereinafter, is disposed in any suitable model, or box, and placed adjacent the powder or propellant grains, the temperature of which is to be measured. A signal proportional to the powder temperature is fed into the amplifier from the TSN where the TSN signal is algebraically combined with $e_{in}/3$ to form a voltage $e_A$, the equation for which includes no constant term. Voltage $e_A$ is used in the ballistic lead angle computations and may be defined thus:

$$e_A = 1.3 \times 10^{-2} e_{in}(T-20) \quad (3)$$

Table I below presents values of $e_A$ for corresponding limiting values of $e_{in}$ and temperature for the normal operating case where the powder temperature is within a predetermined range and hence, the signals from the amplifier are used in the ballistic angle computations. In the situation which is not normal, i.e., when the output voltage of the TSN is outside a predetermined voltage range, for example, less than 1.5 volts or greater than 6.0 volts, a fail light is thus triggered and, $e_{out}$ becomes 0.

Typical values of $e_A$, calculable from equations 1 and 3, are given below:

TABLE I

TYPICAL NORMAL OPERATING & FAILED CONDITIONS

| Case No. | $e_{in}$, volts | T, °C | $e_A$ volts, approx. | Conditon |
|---|---|---|---|---|
| 1 | 6.0 | −55 | 6.0 | Normal |
| 2 | 6.0 | −55 | 40 | TSN Disconnected |
| 3 | 1.5 | −55 | 1.5 | Normal |
| 4 | 1.5 | All temp. | 10 | TSN Disconnected |

Case No. 1 represents the largest normal output, 6.0 volts, that will occur. If this output is fed into the detector, which also serves as a comparator, having a reference voltage set at 8.0 volts, normal outputs will be incapable of activating the detector-comparator to trigger the fail light. With the lowest value of $e_{in}$, i.e., 1.5 volts, whenever the TSN is effectively disconnected from the system, (Case No. 4) an $e_A$ of about 10 volts will result to activate the detector-comparator and the fail light. Returning to Case No. 1, the output, $e_A$, being only 6.0 volts, will not activate the detector, thus the field effect transistor switch, for example, 2N4392 type, is turned on to connect the output to the computational circuitry for necessary ballistic lead angle correction. Should the TSN be damaged or otherwise rendered inoperable such that $e_A$ exceeds the detector reference voltage of 8.0 volts, the detector will then be activated to turn off $Q_1$ and trigger the fail light, thus indicating a failed sensor and apprising the tank gunner that firing degradation exists.

Referring now to FIG. 2 of the drawings, my TSN comprises four precision resistors, $R_1$, $R_2$, $R_3$, and $R_4$, and $Q_2$, a junction field effect transistor, suitably VCR 4N type. When the bias provided by resistors $R_3$ and $R_4$ is adjusted, and a bias voltage of −15 volts is applied to resistor $R_4$, the dynamic resistance of $Q_2$ as a function of temperature is approximately as shown in Table II.

TABLE II

RESISTANCE OF $Q_2$ VS. TEMPERATURE

| Temp., °C | $Q_2$ Resistance, Ohms |
|---|---|
| 70 | 885 |
| 20 | 600 |
| −55 | 223 |

To calibrate the circuit, resistors $R_1$ and $R_2$ are set to nominal values of 3600 and 1200 ohms respectively, for example. With an $e_{in}$ of 6.0 volts rms, resistor $R_3$ is adjusted until $e_{out}$ reads exactly 2.0 volts at 20°C. The temperature may now be changed to +70°C and −55°C, and $e_{out}$ recorded at these points. Resistors $R_1$ and $R_2$ must now be adjusted such that the errors at these two temperature extreme points are within the error allowed by eq. 2, and the 20°C point does not shift. My device is now calibrated.

Summarizing, I have provided a sensitive and accurate fail-safe ammunition or propellant grain or powder temperature sensing system designed for use with the M60A1 computer, said system including no complex thermistor bridge circuits and permitting signals to be fed into the tank's computational circuitry for making necessary ballistic angle changes when the powder temperature falls between a normal safe operating range but which triggers a fail light when the sensing system is damaged or rendered inoperable, or when the powder temperature falls outside normal safe operating conditions.

I claim:

1. Apparatus for estimating powder temperature of ammunition contained within a tank by means of a temperature sensing network connected, in combination, with computer circuitry associated with said tank, said apparatus comprising means for algebraically summing voltages received from said temperature sensing network and an input source, said input voltage being proportional to target range and said temperature sensing network voltage being proportional to said input voltage and said powder temperature, means for amplifying said summed voltages to produce an amplified voltage, a field effect transistor connected between said computer circuitry and said amplifying means, a detector having a predetermined reference voltage associated therewith and connected in circuit with said field effect transistor, said temperature sensing network comprising serially-connected first and second resistors, serially-connected third and fourth resistors, another field effect transistor having two terminals connected in series with said first and second serially-connected resistors, and a third terminal connected to the junction of said third and fourth serially-connected resistors, said another field effect transistor being a junction field effect transistor having a dynamic resistance that is a function of temperature and is disposed to vary the resistance of said sensing network in accordance with the powder temperature of said ammunition, and means connected between the junction of said serially-connected first and second resistors and said amplifying means to apply said temperature sensing voltage thereto whereby said field effect transistor is caused to be turned on when said amplified voltage is less than said reference voltage to produce an output to said computer for correcting ballistic lead angle to compensate for variance from a predetermined powder temperature, and when said amplified voltage exceeds said reference voltage to turn off said field effect transistor and to trigger a fail light.

2. The apparatus as described in claim 1 wherein a negative bias voltage of −15 volts is applied to said fourth resistor, said third resistor and said another field effect transistor are grounded, and said input voltage applied to said first resistor varies between 1.5 and 6.0 volts.

3. The apparatus as described in claim 2 wherein said another field effect transistor is suitably of the VCR 4N type and wherein said input voltage of 6.0 volts rms applied to said first resistor yields an output voltage between said first and second resistors of 2 volts at 20°C defining a first point, and when temperature is raised to +70°C to yield a second point and a third point when temperature is lowered to −55°C, said third and fourth resistors having such values that errors at said second and third points are within the error, in volts, allowed by an equation, and said first point remains stationary, said equation being:

Error = $\mathbf{1.3\times10^{-2}}$ input voltage + $\mathbf{1.1\times10^{-4}}$ input voltage [$T$−20°C] where $T$ is the ambient temperature in °C.

* * * * *